US008570258B2

(12) United States Patent
Park et al.

(10) Patent No.: US 8,570,258 B2
(45) Date of Patent: Oct. 29, 2013

(54) ORGANIC LIGHT EMITTING DISPLAY AND METHOD OF DRIVING THE SAME WITH A DRIVER WITH REDUCED POWER CONSUMPTION IN STANDBY MODE

(75) Inventors: Sung-Un Park, Yongin (KR); Sung-Cheon Park, Yongin (KR); Wook Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 665 days.

(21) Appl. No.: 12/784,241

(22) Filed: May 20, 2010

(65) Prior Publication Data

US 2011/0025677 A1 Feb. 3, 2011

(30) Foreign Application Priority Data

Aug. 3, 2009 (KR) ..... 10-2009-0071276

(51) Int. Cl.
*G09G 3/32* (2006.01)
*G09G 3/30* (2006.01)

(52) U.S. Cl.
USPC ..... 345/82; 345/76

(58) Field of Classification Search
USPC ..... 345/76–104, 204–215, 690–699; 315/169.3
See application file for complete search history.

(56) References Cited

U.S. PATENT DOCUMENTS

2002/0005843 A1* 1/2002 Kurumisawa et al. ..... 345/204
2004/0233226 A1* 11/2004 Toriumi et al. ..... 345/690
2006/0055336 A1* 3/2006 Jeong ..... 315/169.3
2006/0132474 A1* 6/2006 Lam ..... 345/204
2007/0063959 A1* 3/2007 Iwabuchi et al. ..... 345/100

FOREIGN PATENT DOCUMENTS

KR 1998-702212 7/1998
KR 1020020045442 A 6/2002
KR 10-2006-0114456 11/2006
KR 1020070026441 A 3/2007
KR 10-2007-0099062 10/2007
KR 10-2008-0093750 10/2008

OTHER PUBLICATIONS

KIPO Office action dated Sep. 29, 2011, for Korean Priority Patent Application No. 10-2009-0071276, 2 pages.

* cited by examiner

*Primary Examiner* — Chanh Nguyen
*Assistant Examiner* — James Nokham
(74) *Attorney, Agent, or Firm* — Christie, Parker & Hale, LLP

(57) ABSTRACT

An organic light emitting display capable of reducing power consumption in a standby mode and a method of driving the same. The organic light emitting display includes a pixel unit having a first emission region and a second emission region, wherein the pixel unit is configured to generate a driving current in accordance with data signals and scan signals to emit light so that light is emitted by the pixel unit only in the first emission region in a standby mode, a data driver for transmitting the data signals only to the first emission region in the standby mode, a scan driver for outputting the scan signals, and a power source supplier for generating and outputting voltages of an initialization power source and for blocking the driving current from flowing to the second emission region by utilizing a voltage of the initialization power source in the standby mode.

9 Claims, 4 Drawing Sheets

ORGANIC LIGHT EMITTING DISPLAY AND METHOD OF DRIVING THE SAME WITH A DRIVER WITH REDUCED POWER CONSUMPTION IN STANDBY MODE

CROSS-REFERENCE TO RELATED APPLICATION

This application claims priority to and the benefit of Korean Patent Application No. 10-2009-0071276, filed on Aug. 3, 2009, in the Korean Intellectual Property Office, the entire content of which is incorporated herein by reference.

BACKGROUND

1. Field

One or more embodiments of the present invention relate to an organic light emitting display and a method of driving the same.

2. Description of the Related Art

Various flat panel displays (FPD) that are lighter in weight and smaller in volume than comparable cathode ray tube (CRT) displays are being developed. Non-limiting examples of the FPDs include a liquid crystal display (LCD), a field emission display (FED), a plasma display panel (PDP), and an organic light emitting display.

Among the FPDs, the organic light emitting display displays an image using organic light emitting diodes (OLED) that generate light by re-combination of electrons and holes generated to correspond to the flow of current.

The organic light emitting display is widely utilized in a personal digital assistant (PDA), an MP3 player, and/or a mobile telephone due to its excellent color reproducibility and small thickness.

FIG. 1 is a block diagram illustrating the structure of an organic light emitting display according to an embodiment of the present invention. Referring to FIG. 1, the organic light emitting display includes a pixel unit (a display region) 10, a data driver 20, a scan driver 30, and a controller 40.

A plurality of pixels 11 are arranged in the pixel unit 10 and each of the pixels 11 includes an organic light emitting diode (OLED) that emits light to correspond to the flow of current therein. The pixel unit 10 includes n scan lines S1, S2, . . . , Sn−1, and Sn formed to extend in a first direction (a row direction) and to transmit scan signals, and m data lines D1, D2, . . . , Dm−1, and Dm formed to extend in a second direction (a column direction) crossing the first direction and to transmit data signals.

In addition, the pixel unit 10 receives a first power of a first power source and a second power of a second power source having a lower voltage level than that of the first power source to be driven. Therefore, in the pixel unit 10, current flows to the OLED by utilizing the scan signals, the data signals, the first power source, and the second power source to emit light and to display an image.

The data driver 20 receives data driver control signals DCS and image signals R, G, B data from the controller 40 to generate the data signals. The data driver 20 is coupled to the data lines D1, D2, . . . , Dm−1, and Dm of the pixel unit 10 to apply the generated data signals to the pixel unit 10.

The scan driver 30 receives scan driver control signals SCS from the controller 40 to generate the scan signals. The scan driver 30 is coupled to the scan lines S1, S2, . . . , Sn−1, and Sn to transmit the scan signals to specific rows of the pixel unit 10. The data signal output from the data driver 20 is transmitted to the pixel 11 where the scan signal is transmitted so that the voltage corresponding to the data signal is transmitted to the pixel 11.

The controller 40 controls the data driver 20 and the scan driver 30 so that the pixel unit 10 can display an image.

When the above structured organic light emitting display is used for a mobile telephone, in a standby mode, an image representing date and hour is displayed only on a partial region of the pixel unit and the image is not displayed on the remaining region, that is, the remaining region is displayed black (displays no emitting light).

The image is displayed only on the partial region (a partial screen) in order to reduce power consumption and to increase the use time of a battery of the organic light emitting display.

However, in the standby mode where there are many regions displayed black, the data driver 20 is driven in the same way. Therefore, the power consumptions of the data driver 20 do not change in the standby mode. Therefore, in order to reduce power consumption, an improved method of reducing power consumption in the data driver 20 in the standby mode is needed.

SUMMARY OF THE INVENTION

Aspects of embodiments of the present invention are directed toward an organic light emitting display with a relatively small power consumption and a method of using the same.

Aspects of embodiments of the present invention are directed toward an organic light emitting display capable of reducing power consumption in a standby mode and a method of using the same.

An embodiment of the present invention provides an organic light emitting display, including a pixel unit having a first emission region and a second emission region, wherein the pixel unit is configured to generate a driving current in accordance with data signals and scan signals to emit light so that light is emitted by the pixel unit only in the first emission region in a standby mode; a data driver for transmitting the data signals only to the first emission region in the standby mode; a scan driver for outputting the scan signals; and a power source supplier for generating and outputting voltages of an initialization power source and for blocking the driving current from flowing to the second emission region by utilizing a voltage of the initialization power source in the standby mode.

In one embodiment, the pixel unit includes a plurality of pixels, and each of the pixels includes: an organic light emitting diode (OLED); a first transistor including a first electrode coupled to a first node, a second electrode coupled to a second node, and a gate coupled to a third node so that driving current flows from the first node to the second node in accordance with a voltage of the gate; a second transistor including a first electrode coupled to a data line, a second electrode coupled to the first node, and a gate coupled to a first scan line; a third transistor including a first electrode coupled to the second node, a second electrode coupled to the third node, and a gate coupled to the first scan line; a fourth transistor including a first electrode coupled to the initialization power source, a second electrode coupled to the third node, and a gate coupled to a second scan line; a fifth transistor including a first electrode coupled to a first power source, a second electrode coupled to the first node, and a gate coupled to an emission control line; a sixth transistor including a first electrode coupled to the second node, a second electrode coupled to the organic light emitting diode (OLED), and a gate coupled to the emission control line; and a capacitor including a first electrode coupled to the first power source and a second electrode coupled to the third node.

In one embodiment, the data driver is configured to be driven only in a period where data signals are transmitted to the first emission region in the standby mode.

In one embodiment, the power source supplier is configured to output a first voltage when the initialization power source is set to have the first voltage and a second voltage differing form the first voltage and when the data driver stops driving in the standby mode, and is configured to output the second voltage when the data driver is driven.

In one embodiment, the first voltage is a voltage, at which the driving current is not generated by the first transistor.

Another embodiment of the present invention provides a method of driving an organic light emitting display having a pixel unit having a first emission region and a second emission region, wherein the pixel unit is configured to generate a driving current in accordance with data signals and scan signals to emit light. The method includes: transmitting a voltage of an initialization power source set to have a first voltage or a second voltage differing from the first voltage to the pixel unit and setting the transmitted voltage of the initialization power source as the first voltage in a standby mode to output the first voltage; and converting the transmitted voltage of the initialization power source from the first voltage into the second voltage when data signals are transmitted to the first emission region in the standby mode.

In one embodiment, the pixel unit includes a plurality of pixels, and each of the pixels includes: an organic light emitting diode (OLED); a first transistor including a first electrode coupled to a first node, a second electrode coupled to a second node, and a gate coupled to a third node so that driving current flows from the first node to the second node in accordance with a voltage of the gate; a second transistor including a first electrode coupled to a data line, a second electrode coupled to the first node, and a gate coupled to a first scan line; a third transistor including a first electrode coupled to the second node, a second electrode coupled to the third node, and a gate coupled to the first scan line; a fourth transistor including a first electrode coupled to the initialization power source, a second electrode coupled to the third node, and a gate coupled to a second scan line; a fifth transistor including a first electrode coupled to a first power source, a second electrode coupled to the first node, and a gate coupled to an emission control line; a sixth transistor including a first electrode coupled to the second node, a second electrode coupled to the organic light emitting diode (OLED), and a gate coupled to the emission control line; and a capacitor including a first electrode coupled to the first power source and a second electrode coupled to the third node.

In one embodiment, when the initialization power source has the first voltage, the pixel unit display is displayed black.

In one embodiment, when the initialization power source has the first voltage, an operation of a data driver for transmitting the data signals is stopped.

In the organic light emitting display and the method of driving the same according to embodiments of the present invention, the driving time of the data driver is reduced so that the power consumption of the data driver is reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
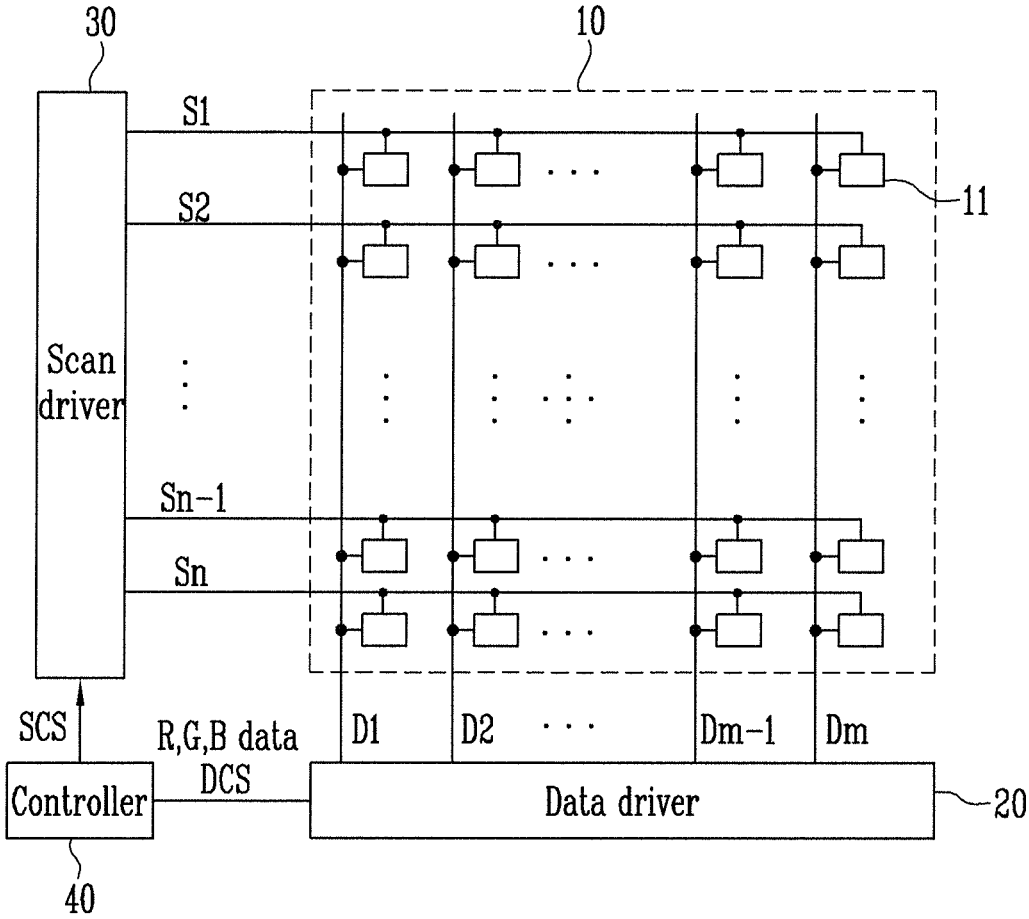
FIG. 1 is a block diagram illustrating the structure of an organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via one or more third elements. Further, some of the elements that are not essential to the complete understanding of the invention are omitted for clarity. Also, like reference numerals refer to like elements throughout.

Hereinafter, an embodiment of the present invention will be described in detail with reference to the accompanying drawings.

Figure 2:
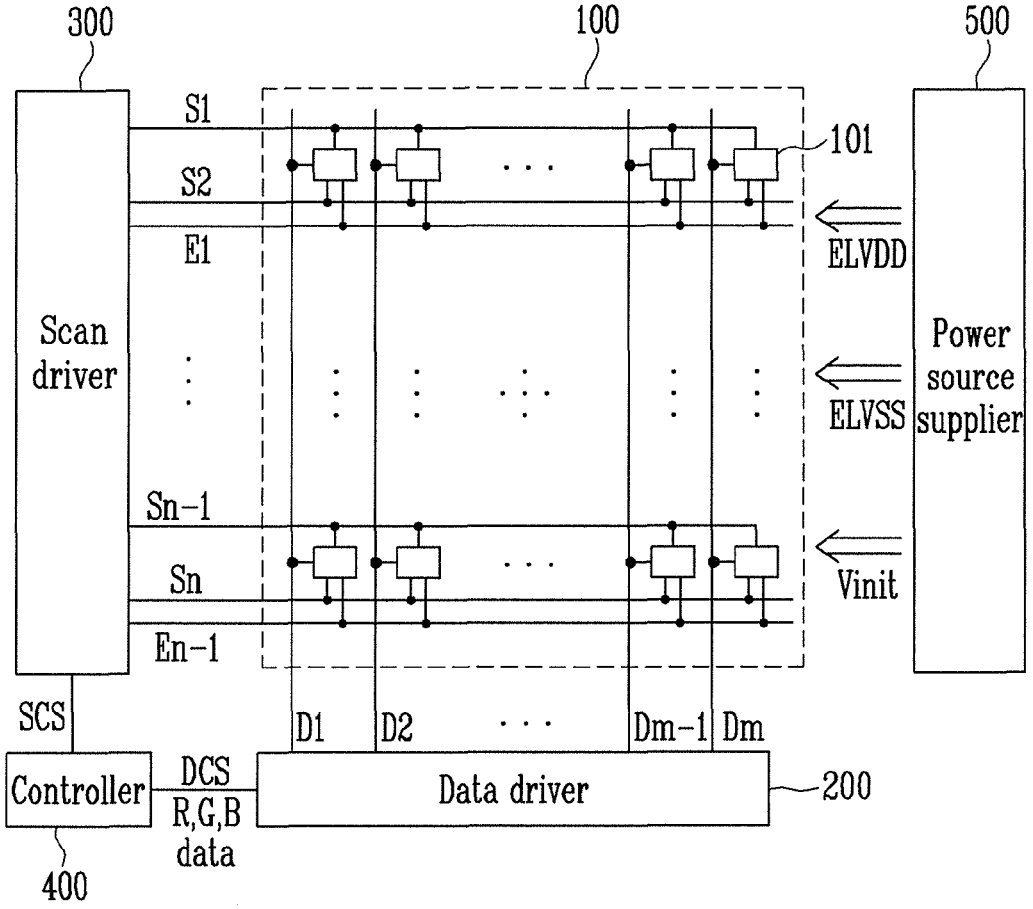
FIG. 2 is a block diagram illustrating the structure of an organic light emitting display according to an embodiment of the present invention.

FIG. 2 is a block diagram illustrating the structure of an organic light emitting display according to the present invention. Referring to FIG. 2, the organic light emitting display includes a pixel unit (display region) 100, a data driver 200, a scan driver 300, a controller 400, and a power source supplier 500.

A plurality of pixels 101 are arranged in the pixel unit 100, and each of the pixels 101 includes an organic light emitting diode (OLED) that emits light to correspond to the flow of current. The pixel unit 100 includes a plurality of scan lines S1, S2, . . . , Sn−1, and Sn formed to extend in a first direction (a row direction) and to transmit scan signals, a plurality of emission control lines E1, . . . , and En−1 formed to extend in the first direction (the row direction) and to transmit emission control signals, and a plurality of data lines D1, D2, . . . , Dm−1, and Dm formed to extend in a second direction (a column direction) crossing the first direction and to transmit data signals.

In addition, the pixel unit 100 receives a first power of a first power source ELVDD and a second power of a second power source ELVSS having a lower voltage level than the first power source ELVDD to be driven. Also, the pixel unit 100 receives an initialization power source Vinit for initializing a voltage stored in the pixel 101. Therefore, in the pixel unit 100, current flows to the OLED by utilizing the scan signals, the data signals, the first power source ELVDD, and the second power source ELVSS to emit light and to display an image. The voltage stored in the pixel 101 is initialized by the initialization power source Vinit.

Here, the pixel unit 100 can be operated to display an image in a standby mode and an image in a display mode. In the standby mode, an image is displayed only in a part of the pixel unit 100 and the remaining part is displayed black (displays no emitting light). Current does not flow to the part displayed black so that the amount of power consumed by the pixel unit 100 is reduced. The shape of the pixel unit 100 in the standby mode will be described in more detail in FIG. 3.

The data driver 200 receives data driver control signals DCS and image signals R, G, B data from the controller 400 to generate the data signals. The data driver 200 is continuously driven in the display mode, however, a period where operation is stopped is generated in a period in one frame in the standby mode. Therefore, the operation of the data driver 200 is stopped so that the amount of power consumed by the data driver 200 is reduced.

The scan driver 300 receives scan driver control signals SCS from the controller 400 to generate the scan signals and the emission control signals. The scan driver 300 is coupled to the plurality of scan lines S1, S2, . . . , Sn−1, and Sn and the plurality of emission control lines E1, . . . , and En−1 to transmit the scan signals to specific rows of the pixel unit 100. The data signal output from the data driver 200 is transmitted to the pixel 101 where the scan signal is transmitted so that the voltage corresponding to the data signal is transmitted to the pixel 101.

The controller 400 transmits the image signals R, G, B data and the data driver control signals DSC to the data driver 200 and transmits the scan driver control signals SCS to the scan driver 300 to control the operations of the data driver 200 and the scan driver 300.

The power source supplier 500 generates the first power of the first power source ELVDD, the second power of the second power source ELVSS, and the initialization power of the initialization power source Vinit to transmit the generated first power of the power source ELVDD, the second power of the second power source ELVSS, and the initialization power of the initialization power source Vinit to the pixel unit 100. Here, the initialization power source Vinit has a first voltage, a second voltage, a third voltage between the first voltage and the second voltage to correspond to the driving of the data driver 200.

Figure 3:
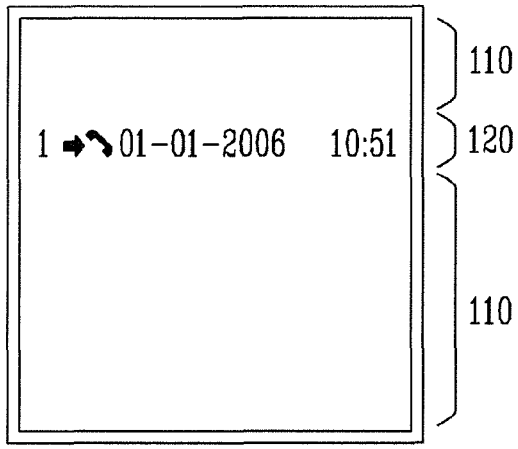
FIG. 3 is a view illustrating an image displayed on the pixel unit of the organic light emitting display of FIG. 2 in a standby mode.

FIG. 3 is a view illustrating an image displayed on the pixel unit of the organic light emitting display of FIG. 2 in a standby mode. Referring to FIG. 3, the organic light emitting display is driven in a display mode where images such as a moving picture and a photograph are displayed and in a standby mode where only date and hour are displayed. The pixel unit is divided into a first emission region 120 and a second emission region 110. The first emission region 120 emits light in the standby mode and the display mode. The second emission region 110 emits light only in the display mode.

The second emission region 110 emits light only in the display mode in order to reduce power consumption in the standby mode. In the standby mode, the icons such as date and hour are displayed on the first emission region 120 and the second emission region 110 does not emit light but is displayed black.

Since the organic light emitting display displays an image to correspond to the current that flows to each pixel, current flows to the pixel positioned in the first emission region 120 in the standby mode and current does not flow to the pixel positioned in the second emission region 110. That is, since the area where light is emitted in the pixel unit 100 in the standby mode is smaller than in the display mode, the amount of the current that flows to the pixel unit 100 in the standby mode is smaller than the amount of the current that flows to the pixel unit 100 in the display mode. Therefore, the power consumption of the pixel unit 100 is reduced.

However, when the data driver 200 performs the same operation as when the data driver 200 operates in the display mode in the case where an image is displayed only in the first emission region 120 that is not the entire region of the pixel unit 100 but is only a part of the pixel unit 100 in the standby mode, in this standby mode, the data driver 200 has the same power consumption as in the display mode. Therefore, in order to effectively reduce power consumption and in one embodiment of the present invention, the data driver 200 stops operating at the point of time where the pixel positioned in the second emission region 110 is selected by the scan signal in the standby mode and the data driver 200 operates at the point of time where the pixel positioned in the first emission region 120 is selected. That is, in order to effectively reduce power consumption, it is necessary that the data signals input to the pixel unit 100 are differently transmitted in the display mode and in the standby mode.

Figure 4:
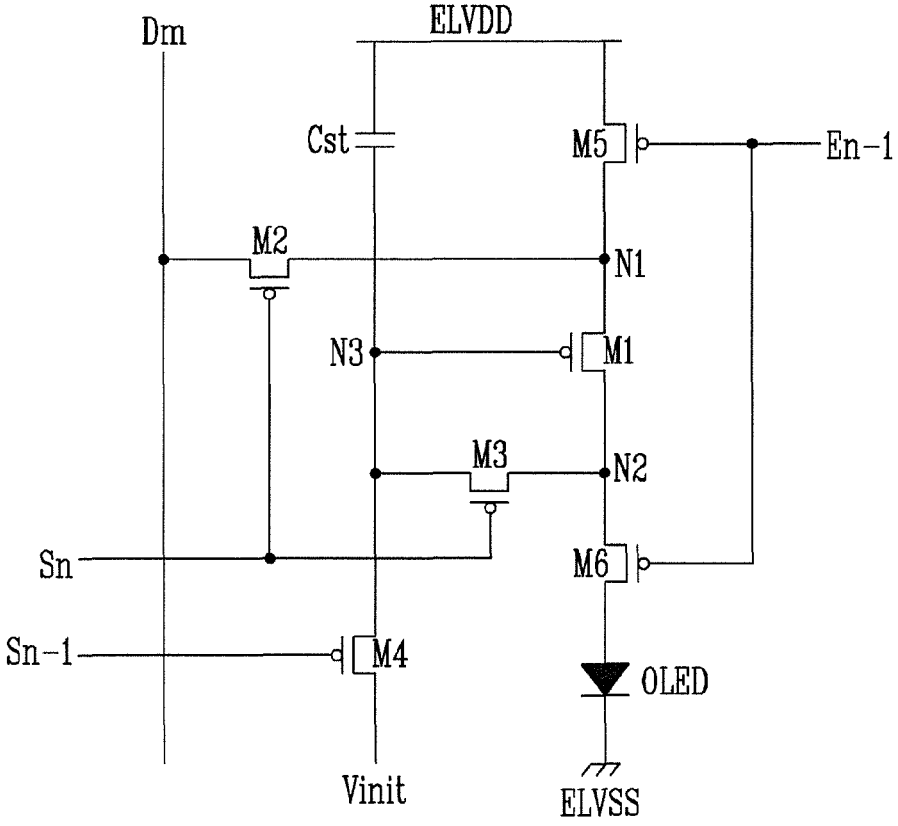
FIG. 4 is a circuit diagram illustrating a pixel adopted by the organic light emitting display of FIG. 2.

FIG. 4 is a circuit diagram illustrating a pixel adopted by the organic light emitting display of FIG. 2. Referring to FIG. 4, the pixel 101 includes a first transistor M1, a second transistor M2, a third transistor M3, a fourth transistor M4, a fifth transistor M5, a sixth transistor M6, a capacitor Cst, and an organic light emitting diode (OLED).

The source of the first transistor M1 is coupled to a first node N1. The drain of the first transistor M1 is coupled to a second node N2. The gate of the first transistor M1 is coupled to a third node N3. Therefore, the amount of the driving current that flows from the source to the drain of the first transistor corresponds to the voltage of the third node N3.

The source of the second transistor M2 is coupled to the data line Dm. The drain of the second transistor M2 is coupled to the first node N1. The gate of the second transistor M2 is coupled to the scan line Sn. Therefore, the data signal transmitted through the data line Dm can be selectively transmitted with the second transistor M2 to the first node N1 in accordance with the scan signal transmitted through the scan line Sn.

The source of the third transistor M3 is coupled to the second node N2. The drain of the third transistor M3 is transmitted to the third node N3. The gate of the third transistor M3 is coupled to the first scan line Sn. Therefore, the second node N2 and the third node N3 are electrically coupled to each other to correspond to the scan signal transmitted through the first scan line Sn so that the voltage of the second node N2 is equal to the voltage of the third node N3 and that the first transistor M1 is diode coupled (connected as a diode by the transistor M3).

The source of the fourth transistor M4 is coupled to the initialization power source Vinit. The drain of the fourth transistor M4 is coupled to the third node N3. The gate of the fourth transistor M4 is coupled to the second scan line Sn−1. Therefore, the initialization power source Vinit is transmitted to the third node N3 to correspond to the scan signal transmitted through the second scan line Sn−1.

The source of the fifth transistor M5 is coupled to the first power source ELVDD. The drain of the fifth transistor M5 is coupled to the first node. The gate of the fifth transistor M5 is coupled to the emission control line En−1. Therefore, the first power of the power source ELVDD can be selectively transmitted with the fifth transistor M5 to the first node N1 in accordance with the emission control signal transmitted through the emission control line En−1.

The source of the sixth transistor M6 is coupled to the second node N2. The drain of the sixth transistor M6 is coupled to the OLED. The gate of the sixth transistor M6 is coupled to the emission control line En−1. Therefore, the transmission of the driving current generated by the first transistor M1 to the OLED is controlled (with the sixth transistor M6) in accordance with the emission control signal transmitted through the emission control line En−1.

The first electrode of the capacitor Cst is coupled to the first power source ELVDD. The second electrode of the capacitor Cst is coupled to the third node N3. Therefore, the voltage of the third node N3 is maintained.

The anode electrode of the OLED is coupled to the first power source ELVDD. The cathode electrode of the OLED is coupled to the second power source ELVSS. A light emitting layer is formed between the anode electrode and the cathode electrode. Light is emitted to correspond to the current that flows from the anode electrode to the cathode electrode. Therefore, light is emitted to correspond to the amount of current that flows through the source of the first transistor M1 and the drain of the first transistor M1.

Figure 5:
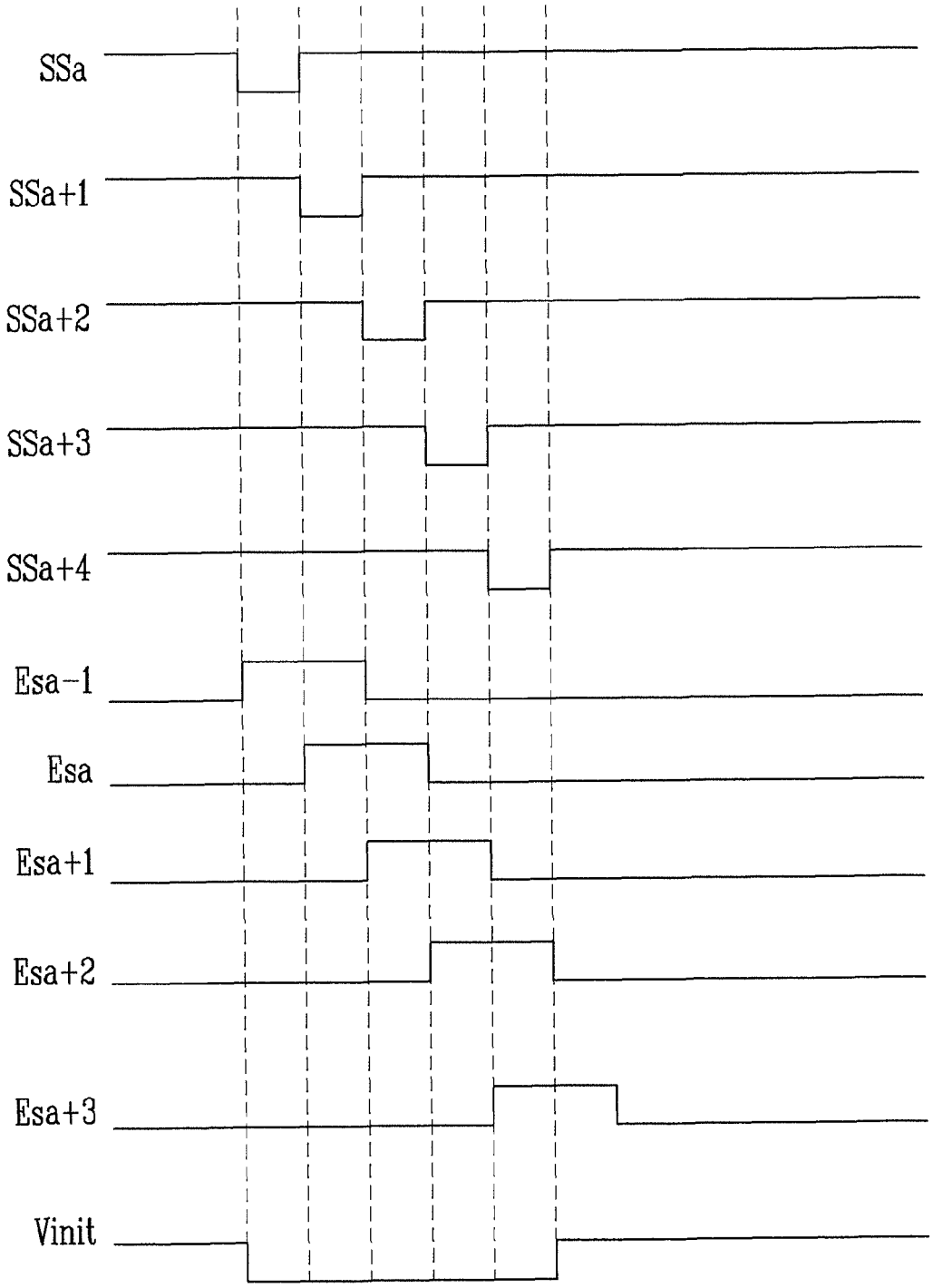
FIG. 5 is a timing diagram illustrating a voltage change in the scan signals, the emission control signals, and the initialization power source input to the organic light emitting display of FIG. 2 in the standby mode.

FIG. 5 is a timing diagram illustrating a voltage change in the scan signals, the emission control signals, and the initialization power source input to the organic light emitting display of FIG. 2 in a standby mode. For convenience sake, in the standby mode, it is assumed that the row of pixels, to which a data signal is transmitted by utilizing an (a+1)th scan signal SSa+1, to the row of pixels, to which a data signal is transmitted by utilizing an (a+4)th scan signal SSa+4, are the pixels positioned in the first emission region 120, in which an image is displayed in the standby mode. Referring to FIG. 5, in the operation of the pixel, initially, the fourth transistor M4 is turned on to correspond to the scan signal transmitted through the second scan line Sn−1. When the fourth transistor M4 is turned on, the initialization power source is transmitted to the third node N3 so that the third node N3 has the voltage of the initialization power source Vinit. The scan signal transmitted through the first scan line Sn is transmitted. The fourth transistor M4 is turned off. The second transistor M2 and the third transistor M3 are turned on. When the second transistor M2 and the third transistor M3 are turned on, the data signal that flows to the data line Dm is transmitted to the first node N1. Then, the second node N2 and the third node N3 are electrically coupled to each other by the third transistor M3 so that the second node N2 and the third node N3 have equal potential. Therefore, the first transistor M1 is diode coupled. At this time, since the fifth transistor M5 and the sixth transistor M6 are turned off by the emission control signal transmitted through the emission control line En−1, current does not flow to the OLED. Here, the third node N3 stores the voltage corresponding to the data signal. Then, when the fifth transistor M5 and the sixth transistor M6 are turned on by the emission control signal transmitted through the emission control line En−1, the third node N3 still stores the voltage corresponding to the data signal. Therefore, since driving current flows from the first node N1 to the second node N2 by the first transistor M1 and the driving current is transmitted to the OLED, the OLED emits light.

In the pixels that operate as described above, in the pixels that receive the data signals by utilizing the first scan signal to the ath scan signal SSa, the initialization power source Vinit has the first voltage. At this time, the first voltage has the same voltage (for example, 4.2V) as the first power of the first power source ELVDD. Therefore, since the initialization power source Vinit having the first voltage is transmitted to the third node N3, the voltage of the third node N3 has the first voltage. When the data signal is transmitted to the first node N1 and the first transistor M1 is diode coupled by the third transistor M3 in the state where the third node N3 has the first voltage, since the third node N3 has a high voltage, the voltage of the third node N3 maintains the first voltage. That is, the voltage of the third node N3 maintains the first voltage regardless of the voltage of the data signal. When the third node N3 has the first voltage, current does not flow from the source of the first transistor M1 to the drain of the first transistor M1 so that the OLED does not emit light. Therefore, the OLED is displayed black. Due to the above, although the data driver 200 does not output the data signal, the OLED is displayed black by the initialization power source.

The pixels that received the data signals by utilizing the (a+1)th scan signal SSa+1 to the (a+4)th scan signal SSa+4 receive the second voltage as the voltage of the initialization power source Vinit. At this time, the second voltage is in a low level (for example, −2V).

Then, when the fourth transistor M4 is turned on, the second voltage is transmitted to the third node N3 by the initialization power source Vinit and the second voltage is maintained in the third node N3 by the capacitor Cst. When the first transistor M1 is diode coupled in a state where the third node N3 has the second voltage, current flows to the third node N3 and the third node N3 has the voltage corresponding to the voltage of the data signal. Then, when the fifth transistor M5 and the sixth transistor M6 are turned on by the emission control signal, since the driving current flows from the source of the first transistor M1 to the drain of the first transistor M1 by the voltage of the third node N3, the driving current corresponding to the data signal flows to the OLED so that the OLED emits light.

Therefore, the data driver 200 can be stopped from being driven for a period of time excluding the period of time where the data signals are received by the pixels positioned in the first emission region 120 by utilizing the (a+1)th scan signal SSa+1 to the (a+4)th scan signal SSa+4. As such, the amount of power consumed by the data driver 200 can be reduced.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a pixel unit having a first emission region and a second emission region, wherein the pixel unit is configured to generate a driving current in accordance with data signals and scan signals to emit light so that light is emitted by the pixel unit only in the first emission region in a standby mode;

a data driver for transmitting the data signals only for the first emission region in the standby mode;

a scan driver for outputting the scan signals; and a power source supplier for generating and outputting voltages of an initialization power source, and for blocking, in the standby mode, the driving current from flowing to the second emission region by providing, in the standby mode, a first voltage when data signals are transmitted for the second emission region, and a second voltage, differing from the first voltage, when data signals are transmitted for the first emission region;

wherein the pixel unit comprises a plurality of pixels, and wherein each of the pixels comprises:

an organic light emitting diode (OLED);

a first transistor comprising a first electrode coupled to a first node, a second electrode coupled to a second node, and a gate coupled to a third node so that driving current flows from the first node to the second node in accordance with a voltage of the gate;

a second transistor comprising a first electrode coupled to a data line, a second electrode coupled to the first node, and a gate coupled to a first scan line;

a third transistor comprising a first electrode coupled to the second node, a second electrode coupled to the third node, and a gate coupled to the first scan line;

a fourth transistor comprising a first electrode coupled to the initialization power source, a second electrode coupled to the third node, and a gate coupled to a second scan line;

a fifth transistor comprising a first electrode coupled to a first power source, a second electrode coupled to the first node, and a gate coupled to an emission control line;

a sixth transistor comprising a first electrode coupled to the second node, a second electrode coupled to the organic light emitting diode (OLED), and a gate coupled to the emission control line; and a capacitor comprising a first electrode coupled to the first power source and a second electrode coupled to the third node.

2. The organic light emitting display as claimed in claim 1, wherein the data driver is configured to be driven only in a period where data signals are transmitted for the first emission region in the standby mode.

3. The organic light emitting display as claimed in claim 1, wherein the first voltage is a voltage, at which the driving current is not generated by the first transistor.

4. A method of driving an organic light emitting display having a pixel unit having a first emission region and a second emission region, wherein the pixel unit is configured to generate a driving current in accordance with data signals and scan signals to emit light, the method comprising, in a standby mode:

transmitting a first voltage from an initialization power source when data signals are transmitted for the second emission region; and transmitting a second voltage form an initialization power source when data signals are transmitted for the first emission region;

wherein the pixel unit comprises a plurality of pixels, and wherein each of the pixels comprises:

an organic light emitting diode (OLED);

a first transistor comprising a first electrode coupled to a first node, a second electrode coupled to a second node, and a gate coupled to a third node so that driving current flows from the first node to the second node in accordance with a voltage of the gate;

a second transistor comprising a first electrode coupled to a data line, a second electrode coupled to the first node, and a gate coupled to a first scan line;

a third transistor comprising a first electrode coupled to the second node, a second electrode coupled to the third node, and a gate coupled to the first scan line;

a fourth transistor comprising a first electrode coupled to the initialization power source, a second electrode coupled to the third node, and a gate coupled to a second scan line;

a fifth transistor comprising a first electrode coupled to a first power source, a second electrode coupled to the first node, and a gate coupled to an emission control line;

a sixth transistor comprising a first electrode coupled to the second node, a second electrode coupled to the organic light emitting diode (OLED), and a gate coupled to the emission control line; and a capacitor comprising a first electrode coupled to the first power source and a second electrode coupled to the third node.

5. The method as claimed in claim 4, wherein, when the initialization power source transmits the first voltage, the pixel unit is displayed black.

6. The method as claimed in claim 4, wherein, when the initialization power source transmits the first voltage, an operation of a data driver for transmitting the data signals is stopped.

7. An organic light emitting display, comprising:

a pixel unit having a first emission region and a second emission region, wherein the pixel unit is configured to generate a driving current in accordance with data signals and scan signals to emit light so that light is emitted by the pixel unit only in the first emission region in a standby mode;

a data driver for transmitting the data signals only for the first emission region in the standby mode;

a scan driver for outputting the scan signals; and an initialization power source configured to provide, in the standby mode, a first voltage when data signals are transmitted for the second emission region, and a second voltage, differing from the first voltage, when data signals are transmitted for the first emission region;

wherein the pixel unit comprises a plurality of pixels, and wherein each of the pixels comprises:

an organic light emitting diode (OLED);

a first transistor comprising a first electrode coupled to a first node, a second electrode coupled to a second node, and a gate coupled to a third node so that driving current flows from the first node to the second node in accordance with a voltage of the gate;

a second transistor comprising a first electrode coupled to a data line, a second electrode coupled to the first node, and a gate coupled to a first scan line;

a third transistor comprising a first electrode coupled to the second node, a second electrode coupled to the third node, and a gate coupled to the first scan line;

a fourth transistor comprising a first electrode coupled to the initialization power source, a second electrode coupled to the third node, and a gate coupled to a second scan line;

a fifth transistor comprising a first electrode coupled to a first power source, a second electrode coupled to the first node, and a gate coupled to an emission control line;

a sixth transistor comprising a first electrode coupled to the second node, a second electrode coupled to the organic light emitting diode (OLED), and a gate coupled to the emission control line; and a capacitor comprising a first electrode coupled to the first power source and a second electrode coupled to the third node.

8. The organic light emitting display as claimed in claim 7, wherein the data driver is configured to be driven only in a period where data signals are transmitted for the first emission region in the standby mode.

9. The organic light emitting display as claimed in claim 7, wherein the first voltage is a voltage, at which the driving current is not generated by the first transistor.

* * * * *

UNITED STATES PATENT AND TRADEMARK OFFICE

CERTIFICATE OF CORRECTION

PATENT NO. : 8,570,258 B2
APPLICATION NO. : 12/784241
DATED : October 29, 2013
INVENTOR(S) : Sung-Un Park et al.

It is certified that error appears in the above-identified patent and that said Letters Patent is hereby corrected as shown below:

In the Claims

Column 9, Claim 4, line 31 Delete "form"

Insert -- from --

Signed and Sealed this
Twenty-fourth Day of March, 2015

Michelle K. Lee

Michelle K. Lee
*Director of the United States Patent and Trademark Office*